US009289773B2

(12) United States Patent
Kawatsu

(10) Patent No.: US 9,289,773 B2
(45) Date of Patent: Mar. 22, 2016

(54) VERTICAL MILL ROLLER

(75) Inventor: Hajime Kawatsu, Toyonaka (JP)

(73) Assignee: ING SHOJI Co., Ltd., Osaka-shi (JP)

( * ) Notice: Subject to any disclaimer, the term of this patent is extended or adjusted under 35 U.S.C. 154(b) by 519 days.

(21) Appl. No.: 13/805,841

(22) PCT Filed: Jul. 26, 2010

(86) PCT No.: PCT/JP2010/062546

§ 371 (c)(1),
(2), (4) Date: Mar. 27, 2013

(87) PCT Pub. No.: WO2012/014271

PCT Pub. Date: Feb. 2, 2012

(65) Prior Publication Data

US 2013/0175378 A1 Jul. 11, 2013

(51) Int. Cl.
*B02C 15/04* (2006.01)
*B02C 15/00* (2006.01)

(52) U.S. Cl.
CPC ..... *B02C 15/004* (2013.01); *B02C 15/00* (2013.01)

(58) Field of Classification Search
CPC ..... B02C 15/004; B02C 15/04
USPC ..... 241/117–121, 293
See application file for complete search history.

(56) References Cited

U.S. PATENT DOCUMENTS 1,517,036 A * 11/1924 Wagner ..... 241/293
1,679,241 A * 7/1928 David ..... 241/38
1,879,897 A * 9/1932 Gernelle-Danloy ..... 241/115
2,017,850 A * 10/1935 Boothman ..... 241/3
3,866,643 A * 2/1975 Schaefer ..... 144/241
4,611,765 A * 9/1986 Shimojima et al. ..... 241/121

FOREIGN PATENT DOCUMENTS

| | | |
|---|---|---|
| JP | 60 58248 | 4/1985 |
| JP | 61 74655 | 4/1986 |
| JP | 03086255 | 4/1991 |
| JP | 06198206 | 7/1994 |
| JP | 2009 142809 | 7/2009 |

OTHER PUBLICATIONS

International Search Report Issued Oct. 26, 2010 in PCT/JP10/62546 Filed Jul. 26, 2010.

* cited by examiner

*Primary Examiner* — Faye Francis
(74) *Attorney, Agent, or Firm* — Oblon, McClelland, Maier & Neustadt, L.L.P.

(57) ABSTRACT

In grinding of a raw material by a vertical roller mill, highly-efficient grinding is performed irrespective of the type of the raw material, and the life of the mill roller is extended. In order to achieve these, in a grinding roller used in a vertical roller mill, an outer circumferential surface of the roller as a grinding surface is divided into a main grinding surface that mainly performs pulverizing and a grinding surface other than the main grinding surface. The main grinding surface is made smooth, and the grinding surface other than the main grinding surface is a raw material transfer surface in which slit grooves inclined at 90 degrees or an angle exceeding 45 degrees relative to a roller circumferential direction or screw grooves inclined at 45 degrees or smaller relative to the roller circumferential direction are formed.

7 Claims, 7 Drawing Sheets

VERTICAL MILL ROLLER

TECHNICAL FIELD

The present invention relates to a vertical mill roller used in a vertical roller mill and, in particular, a universal vertical mill roller suitable for pulverizing coal, petroleum coke, and the like, as well as grinding materials such as limestone, ground fine powder of which tends to adhere to a surface of a roller.

BACKGROUND ART

Power generating boilers using coal or petroleum coke as fuel have been heavily used. Reasons for the heavy use are low fuel costs, easy adjustment of electricity generated and so on, and therefore, developing countries such as China as well as Japan depend on coal and petroleum coke for most of electricity generated. However, coal and petroleum coke have a major disadvantage of discharge of a large amount of carbon dioxide.

To the world, Japan made a public commitment to reduce the amount of discharged carbon dioxide in the year 1990 by 25% until the year 2020. This commitment shows an extremely difficult numerical value to achieve, and the public and the Industry must fulfill their large obligations. However, because of having made the commitment, Japan must work toward the aim. Therefore, it is very important to reduce the amount of carbon dioxide discharged from coal and petroleum coke, which are used in the power generating boilers.

Since the use of coal and petroleum coke as fuels for power generation leads to discharge of a large amount of carbon dioxide, these fuels are regarded as sources of the all evil in terms of discharging of carbon dioxide. However, it is impossible for resource-poor Japan to immediately stop coal among all fossil fuels. At least until nuclear power generation and clean alternative energy are prepared, the use of coal cannot be stopped because of its economic efficiency, its convenience, rich reserve and difficulty in depletion.

Therefore, a future technically important object is to reduce the amount of carbon dioxide discharged from these fossil fuels as much as possible, and development of a new technology to attain this object is an essential theme. In this connection, pulverization in a grinding stage of coal and petroleum coke that are supplied to the boiler and reduction of the amount of generated carbon dioxide by the pulverization should be considered. Although the reduction effect achieved by one grinding mill is insignificant, the mills used all over the world is too numerous to count, which result in drastic reduction of the amount of discharged carbon dioxide. Advanced countries, in particular, Japan as a technology-oriented nation have the mission and obligation to take the initiative in working on the pulverization in the grinding mill.

The present inventors have noted this matter early on, worked on the pulverization in the grinding mill, and achieved great results. A typical technology is an improvement in the shape of a grinding surface of a roller, which is described in Patent Documents 1 and 2, in particular, development of a slit roller. In the slit roller, slit grooves extending in a center line direction (direction perpendicular to a roller circumferential direction) are formed in an outer circumferential surface as the grinding surface of the grinding roller at regular intervals in the circumferential direction. Thereby, as compared to the existing vertical roller mills, the biting property of ground matters and the pulverization rate are improved.

That is, in the case of a thermal power plant, at present, the ground coal grains passing through a 200 mesh screen are 75% on average. However, by further reducing the ground grain size so as to collect a larger amount of fine powder passing through the 200 mesh screen with over 75%, as compared with conventional mills, the combustion efficiency of the boiler is improved, enabling complete combustion and contributing a decrease in the amount of discharged carbon dioxide.

In producing pig iron in a blast furnace in a steelmaking plant, a large amount of coke reducing gas is generated and used to reduce and melt iron ore. Since coke is produced from expensive binding coal and is so expensive, in order to reduce the amount of used coke, inexpensive powdered coal is blown from a tuyere of the blast furnace to decrease the amount of consumed coke, thereby cutting pig iron manufacturing costs.

The slit roller developed by the present inventors has been widely adopted in blast furnace powdered coal blowing equipment, which greatly contributes to cost reduction. It is said that the cost reduction effect in a certain steelmaking plant achieves as much as 600 million to 700 million yen annually. Since the amount of produced powder of 200 meshes or less is larger than that of conventional mills by about 20% or higher, the combustion efficiency of the blast furnace is improved, which contributes further reduction of the amount of consumed coke. In other words, the reduction of the amount of consumed coke leads to reduction of carbon dioxide occurring at production of coke, thereby largely contributing reduction of discharged carbon dioxide.

The vertical roller mill has been heavily used as a coal grinder in the power generating boiler. The vertical roller mill is configured of one horizontally-rotating driving table and a plurality of grinding rollers arranged on the driving table so as to surround the rotational center line, and coal supplied from the center of the mill to the center of the table is carried outward by a centrifugal force and pinched between the rollers and the table, thereby sequentially grinding coal. The ground coal is carried upward by carrying air, classified by a classifier. Out of the coal, coal of required grain size is captured and transferred to a subsequent stage, and coal of larger grain size is returned into the mill again.

The vertical roller mill for coal grinding is broadly classified into a Loesche type in which the shape of the grinding roller is truncated cone and an annular grinding part on an upper surface of the rotating table is a horizontal surface, and a tire type in which an outer circumferential surface of the grinding roller is curved in a plane vertical to the rotating direction so as to protrude toward the outer circumference, and an annular groove having an arcuate cross section, which is engaged with the outer circumferential surface of the grinding roller is formed on the upper surface of the rotating table. The tire-type grinding roller is further classified into a convex tire having a ratio of a maximum diameter D to radius of curvature R of a surface vertical to the rotating direction of the tire grinding surface of 4.3 or higher, and a flat tire having the ratio less than 4.3. According to the present inventors' research of D/R of the commercially available tire-type rollers, an average D/R of the convex tire is in the range of 4.5 to 5.0, and an average D/R of the flat tire is in the range of 3.8 to 4.1. Thus, D/R of 4.3 is reasonable as a diverging point of both D/R.

The present inventors have researched a screw roller in addition to the slit roller. The screw roller is a roller in which a plurality of screw grooves (spiral grooves) inclined relative to the roller circumferential direction are provided in parallel in the roller outer circumferential surface (Patent Documents 3, 4). The slit grooves in parallel to a roller shaft (vertical to the roller circumferential direction) are excellent in the biting property of a raw material, but is significantly high in the ability to scatter the material. On the contrary, circumferential grooves vertical to the roller shaft (roller circumferential direction) cannot obtain the good biting property of the ground raw material. By making the screw-like slit grooves so as to collect the ground raw material toward the center of the table, the amount of inserted ground raw material in a grinding space formed between the roller and the table increases. Thus, even in the case of the same roller clearance, a contact frictional force with the roller increases, thereby possibly preventing mill oscillation at a low-load operation and the like in the thermal power plant.

However, the long-term experience and experiment study of the present inventors demonstrate that the vertical grinding roller in which the slit grooves are formed on the entire grinding surface to improve the biting property and the grinding roller having the screw grooves that are excellent in the transfer property of the ground raw material have common problems.

That is, both in the roller with the slit grooves and the roller with the screw grooves, their added values cannot be completely exhibited for the ground raw material having a high hardness due to excessive wear, and the inventors have looked for its solution. If this problem is solved, the grinding roller with the slit grooves and the grinding roller with the screw grooves can realize a perfect vertical mill roller capable of sufficiently proving the merit of the grinding property for every grinding materials, that is, all of materials having a high hardness, materials having a high water content and adhesive materials, except for ignitable materials.

Then, the present inventors got back to the basic, and decided to clarify true functions and effects of the existing grinding rollers and develop a fundamentally new grinding surface. For this reason, the present inventors first examined problems common to the roller with the slit grooves and the roller with the screw grooves. As a result, two following problems related to the roller circumferential direction and the roller shaft direction emerged.

The first problem relates to wear of the grinding surface of the grinding roller in the roller circumferential direction (rotating direction). Details will be described below. When a hard material is ground, the slit grooves are disadvantageously prone to early wear. That is, conventionally, the slit grooves are formed in the entire roller grinding surface. In such a grinding roller, when a soft material is ground, wear of soft ribs constituting the slit grooves gradually develop to form the slit grooves, and wear-resistant hardened metal existing between the soft ribs appears in the shape of a gear. However, since the ground raw material is soft, the edge of the appeared hardened metal is not subjected to wear and holds to be almost vertical, resulting in that the excellent biting property and wear resistance are kept for a long time, thereby maintaining the effects and life of the roller and achieving a satisfactory use result. In the case where the soft raw material is ground, even when the slit grooves or the screw groove are formed in the entire roller grinding surface, the effects can be sufficiently obtained.

For example, in the case of grinding of coal having HGI of 45 or higher and grinding of slag in the blast furnace, the productivity can be greatly improved and the life can be largely extended.

On the other hand, when a very hard ground raw material is ground, the soft ribs constituting the slit grooves early wear, wear-resistant metal in the shape of a gear appears in a short time, and corners of the wear-resistant metal efficiently grind the hard material to improve the grinding efficiency. However, due to the hard material, the sharp gear-like shape extremely wears and early changes to a mountain-like shape, the grinding efficiency gradually lowers. At the same time, replacement is required within a short time as a result of the extreme wear. The wear speed is much higher than that of the existing circumferential wound build-up welding roller.

For example, for the cement raw material grinding roller used in a cement factory, the production volume per unit time increases by about 20% or more, but the life becomes a half of the existing build-up welding roller or shorter. Further, in the case where highly hard silica stone and ceramics, non-weathered blast furnace slag, and low-quality coal containing much ash are ground, the wear speed extremely increases.

Based on the phenomenon, the present inventors determined that the life of the roller with the slit grooves and the roller with the screw grooves did not depend on only the wear resistance of the adopted wear-resistant metal, and largely depended on the shape of the grinding surface. As an example, numeral analysis demonstrates that the pressure applied on the gear-shaped edge of the roller with the slit grooves by the wear-resistant hardened metal is about three times as much as the pressure applied on the circumferential wound build-up welded smooth grinding surface of the tire-type roller by the same hardened metal.

Since wear is generally proportional to the power of the pressure applied to the wear surface, it is assumed that the edge is subjected to wear that is 2 to 4 times as much as the pressure than the smooth surface. Accordingly, the pressing need is to develop a new grinding surface capable of exhibiting efficient grinding of the slit grooves even when the hard ground raw material, and moreover, ensuring the same life as that of the smooth grinding surface even when metal having the same wear resistance.

The second problem relates to wear of the grinding surface of the grinding roller in the roller shaft direction. That is, when observing wear of the grinding roller, in the grinding surface of the trapezoidal roller in a stage where the grinding efficiency lowers and the roller should be exchanged, a deep wear groove occurs on the large-diameter side, and no wear occur on the small-diameter side. In the tire-type convex roller having a small curvature (D/R=5), like the trapezoidal roller, maximum wear occurs mainly on the large diameter, and the tire-type flat roller having a large curvature (D/R=4), maximum wear occurs on the small-diameter side.

It can be determined that the grinding part generating maximum wear is a part that contributes to the grinding most in the entire roller grinding surface, and has a largest ground amount, in which pulverizing is mainly performed. Although the other grinding surface also grinds fine powder as a matter of course, since it does not wear so much, it is assumed that the surface is a transfer surface that acts to feed the ground raw material supplied to the center of the rotating table to the main grinding surface by a centrifugal force rather to perform pulverizing. The transfer grinding surface is a part that first bites the raw material and serves to crush the material having a large grain size. It is assumed that the grinding property of fine powder can be greatly improved by improving the raw material transfer property on the transfer grinding surface by any means. At development of the slit grooves, the present inventors focused on only the biting property, but they developed the screw grooves capable of effectively grinding the adhesive substances such as limestone without adhesion to the roller and then, found the importance of the raw material transfer property of the grinding surface.

Theoretically considering, the roller grinding surface includes two grinding surfaces including the main grinding surface where pulverizing is mainly performed and the transfer surface where the raw material is fed to the main grinding surface. By clarifying role sharing of the grinding surfaces, any kinds of raw material can be transferred to the main grinding surface stably and reliably. This enables design of the grinding surface capable of reducing wasted energy necessary for grinding and performing grinding more efficiently, and prevents wear of the main grinding surface. This could be recognized based on long-term experience and trial and error from past to present.

As described above, one of important roles of the grinding surface is the raw material transfer property. In fact, it turns out that the existing smooth surface roller does not perform the function. When a hard ground raw material or a moist ground raw material is ground, since the grinding surface is a smooth surface, the biting property and the transfer property are poor, and the roller slips, thereby generating a large oscillation in the grinder itself to make its operation difficult. As a result, the production volume of fine powder decreases. When excessive pressure is applied to the roller in order to suppress slip and oscillation of the roller, an axis current of the mill increases, generating a large power loss.

PRIOR ART DOCUMENTS

Patent Documents

Patent Document 1: Japanese Patent No. 1618574

Patent Document 2: Japanese Patent No. 2863768

Patent Document 3: Japanese Unexamined Utility Model Application Publication No. 63-111939

Patent Document 4: International Publication No. WO2009/157335

SUMMARY OF THE INVENTION

Problems to be Solved by the Invention

An object of the present invention is to provide a high-performance and economical vertical mill roller that can solve the problems of the grinding surface of the grinding roller in the circumferential direction and the axial direction, and maintain the excellent grinding property for a long time.

Means for Solving the Problems

Theoretically considering, the grinding surface that performs the most important role for the productivity of fine powder is the main grinding surface. To make the operation of grinding of fine powder more effective, excessive grooves such as the slit grooves or the screw grooves can be removed from the main grinding surface, thereby increasing the effective surface area of the grinding surface. Apparently, this can improve the grinding efficiency of the fine powder. When the main grinding surface can be made smooth, as a matter of course, the phenomenon that the gear-shaped hardened metal edge is subjected to excessive wear disappears, thereby extending the life and increasing the production volume of the fine powder as in the smooth surface. Doing that will serve two purposes. This is the first step to provide a perfect solution.

However, by merely making the main grinding surface smooth, the amount of ground fine powder cannot be increased. Unless the ground raw material is supplied to the main grinding surface continuously and stably, it is difficult to improve the productivity of fine powder. Accordingly, it is need to add the grinding surface other than the main grinding surface, and for this purpose the transfer capability to reliably feed any kind of raw material to the main grinding surface is required.

When a large amount of raw material is fed to the grinding surface, the layer thickness of the raw material becomes large in a grinding chamber formed between the roller and the table, and friction between the raw materials become significant, improving the productivity of fine powder. When the pressure applied to the roller is constant, the layer thickness increases with an increase in the biting amount. As a result, the workload and in turn, the axial current of the mill increase, but the amount of ground fine powder also increases. Based on comparison in the electric power consumption rate obtained by dividing the power consumption by the amount of collected fine powder of target grain size, as a denominator increases, the electric power consumption rate lowers, contributing to energy saving. In terms of correlation between the roller grinding surface area and power consumption, as the roller surface area increases, the frictional resistance and the power consumption increase. Since the 100% smooth main grinding surface is needed, the contact area cannot be reduced, but since the transfer surface does not mainly perform grinding, the grooves may be formed in the transfer surface to decrease the contact area.

In the vertical roller mill, given that one grinding surface of the grinding roller can fulfill two roles: the main grinding surface that mainly grinds fine powder and the grinding surface that transfers the ground raw material to the main grinding surface, the roller grinding property can be easily understood. As an example, the trapezoidal roller will be considered. The main grinding surface that mainly performs grinding of fine powder exists on the large-diameter side, and the grinding surface that transfers the raw material to the large-diameter side exists on the small-diameter side. In this manner, the grinding area is clearly divided into two. Originally, the grinding operation is not separately performed in this manner. In the vertical roller mill, the ground raw material is supplied from the center of the mill and then, is transferred toward the outer side of the table with rotation by a centrifugal force. During this period, as the granular raw material is pinched between the gap between the roller and the table and movies toward the outer side of the table, coarse grains are gradually ground into fine grains. As a matter of course, although grinding is performed also on the small-diameter side, the frequency is very high on the large-diameter side, while coarse grains are mainly bitten on the small-diameter side and transferred to the large-diameter side while being ground into fine grains. Grinding of fine powder is performed mainly in the main grinding area. As evidence, extreme wear occurs on the grinding surface on the large-diameter side where the grinding action is fierce, and wear hardly develops on the small-diameter side.

From these facts and verification, the present inventors derived theoretically and empirically that the main grinding surface that mainly performed grinding of fine powder and the raw material transfer surface that transferred the raw material to the main grinding surface stably and reliably coexisted in one roller grinding surface, and the effective grinding effect could not be obtained whichever was lacking.

It was demonstrated from a grinding test that, in grinding of the raw material having a low adhesiveness, the slit grooves having an angle in the range of 0 to 45 degrees relative to the roller shaft were effective in improving the biting property, and in grinding of the raw material having a high adhesiveness, the screw groove having an angle in the range of 45 to 85 degrees were effective in decreasing adhesion to the roller and improving the transfer property, and by including the two types of grooves, the grinding property for all kinds of ground raw materials could be improved.

The vertical mill roller according to the present invention is an innovative grinding roller developed based on such findings, and is a grinding roller for the vertical roller mill having a hybrid grinding surface structure in which the roller grinding surface includes the main grinding surface that mainly performs pulverizing and the grinding surface other than the main grinding surface, the main grinding surface is made smooth, and slit grooves inclined at 90 angles or an angle exceeding 45 degrees relative to the roller circumferential direction, or the screw grooves inclined at 45 degrees or smaller relative to the roller circumferential direction are formed in the grinding surface other than the main grinding surface.

Judging from the function of the grinding surface of the grinding roller, the main grinding surface is made smooth to increase the amount of ground fine powder and decrease wear. In the case of the ground raw material having a low adhesiveness, the slit grooves inclined at a large angle relative to the roller circumferential direction to improve the biting property, or the screw grooves inclined at a small angle relative to the roller circumferential direction to improve the transfer property are formed in the grinding surface other than the main grinding surface. In the case where the ground raw material is an adhesive substance, the screw grooves inclined at an angle in the range of 45 to 85 degrees relative to the roller shaft (in the range of 5 to 45 degrees relative to the roller circumferential direction) are formed. The reason is that a groove angle in parallel to the roller shaft or less than 45 degrees relative to the roller shaft brings the good biting property and causes adhesion or transference to the roller surface, thereby making the grinding operation difficult. Thus, the groove angle that brings the good transfer property rather than the biting property is desirable, and specifically, an angle in the range of 45 to 85 degrees, especially, an angle in the range of 60 to 70 degrees as an average angle is desirable as an angle for the screw groove.

As a method of making the main grinding surface smooth, in the trapezoidal roller, since the grinding surface is flat in the roller shaft direction, the main grinding surface and the transfer surface can be clearly distinguished from each other and formed. In the tire-type flat roller having a large R, the main grinding surface tends to exist on the small-diameter side, whereas in the tire-type convex roller having a small R, the main grinding surface tends to exist on the tire center side (large-diameter side). However, for the tire-type roller, since the main grinding surface exists in a curved surface curved in the roller shaft direction, it is more difficult to make the main grinding surface flat than the trapezoidal roller.

Accordingly, in the tire-type roller, the smooth surface is formed in the area corresponding to the main grinding surface by adding the area of the grooves itself to the effective grinding area such that the slit grooves are made shallower than those in the other area and filling the shallow grooves with the ground raw material, or by previously the slit grooves in the entire grinding surface and then, filling the slit grooves in the area corresponding to the main grinding surface by build-up welding. This method can be applied to the grinding roller of any shape.

Effects of the Invention

The vertical mill roller according to the present invention can prevent extreme wear unique to the slit grooves by making the main grinding surface subjected to wear most smooth on the basis of the worldwide new grinding theory, and can at least improve wear to the same level of wear of the smooth surface, and further make the effective grinding surface area 100%, which contribute to improvement of the production volume of the fine powder.

For power consumption of the grinder, by decreasing the area of the raw material transfer surface through the role sharing of the grinding surface to make the contact area smaller than that of the smooth surface roller, wasted electric power can be reduced.

For the present inventors who have continued to research the shape of the grinding surface for a long time, one of the final objects is to establish the comprehensive grinding surface technology including the slit grooves and the screw grooves. The present inventors succeeded in developing the perfect shape of the grinding surface that achieved unprecedented excellent effects by further improving, especially, the effects of the screw grooves. The result is the above-mentioned innovative grinding surface shape.

BRIEF DESCRIPTION OF THE DRAWINGS

FIG. 1A shows the conventional roller, and FIG. 1B shows the roller of the present invention.

FIG. 2A shows the conventional roller, and FIG. 2B shows the roller of the present invention.

FIG. 3A shows the conventional roller, and FIG. 3B shows the roller of the present invention.

FIG. 4A shows the conventional roller, and FIG. 4B shows the roller of the present invention.

FIG. 5A shows the conventional roller, and FIG. 5B shows the roller of the present invention.

BEST MODE FOR CARRYING OUT THE INVENTION

An embodiment of the present invention will be described below with reference to the drawings.

All of vertical mill rollers shown in FIGS. 1 to 5 are grinding rollers used for vertical mill roller.

Figure 1B:
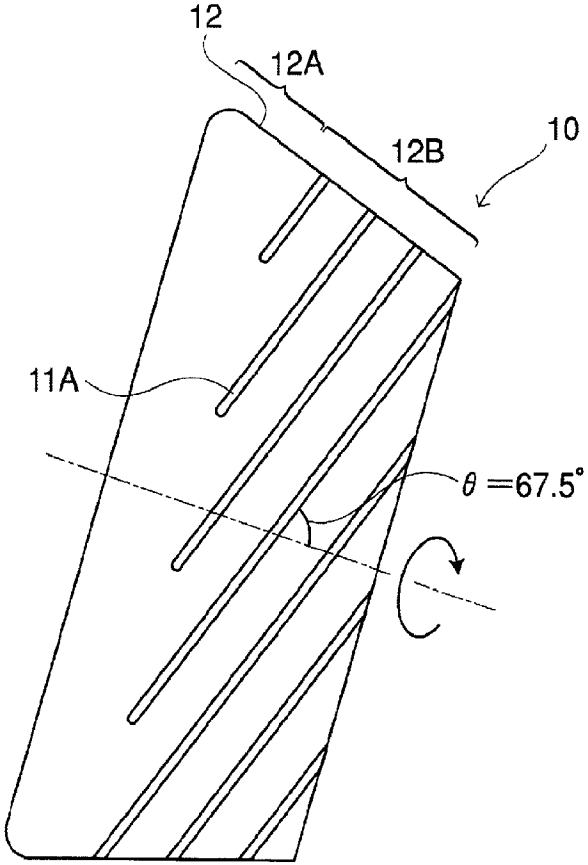
FIGS. 1A and 1B are front views showing a trapezoidal roller as a vertical mill roller of the present invention in comparison with a conventional roller.
Figure 1A:
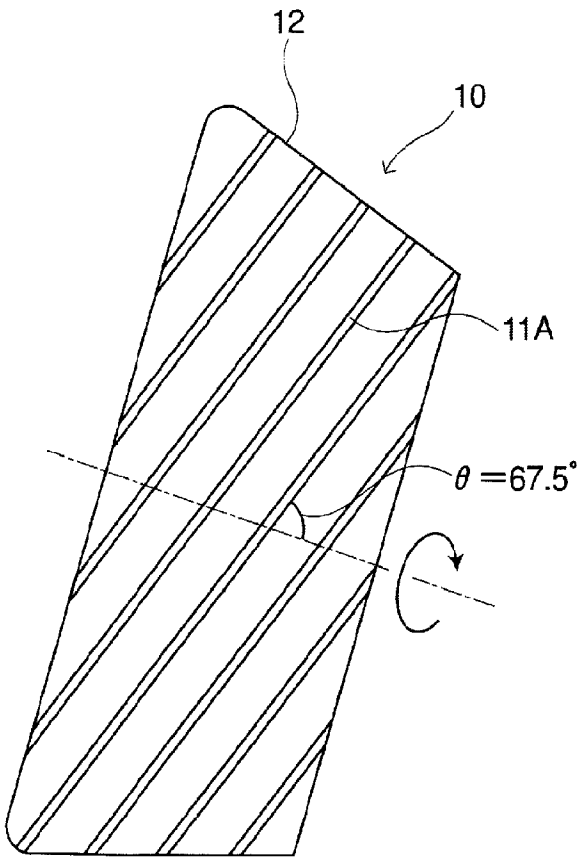
FIG. 1A PRIOR ART

The vertical mill roller shown in each of FIGS. 1A and 1B is a trapezoidal roller 10 used in the vertical mill roller called as Loesche mill. The trapezoidal roller 10 shown in FIG. 1A is a conventional roller, and a plurality of screw grooves 11A are formed in an entire outer circumferential surface 12 at regular intervals in the roller shaft direction. An inclined direction of the screw grooves 11A is a raw material discharging direction of actively transferring a ground raw material toward the outer circumference with rotation, and for its inclined angle, it is given that the inclined angle θ relative to the roller shaft is 67.5 degrees, and the inclined angle relative to the roller circumferential direction is 22.5 degrees.

The trapezoidal roller 10 shown in FIG. 1B is a roller according to the present invention in which the outer circumferential surface 12 is broadly divided into a main grinding surface 12A on the large-diameter side, and the other part. The main grinding surface 12A is smooth. The plurality of screw grooves 11A are formed in the part other than the main grinding surface 12A at regular intervals in the roller shaft direction. The inclined direction of the screw grooves 11A is a raw material discharging direction of actively transferring the ground raw material toward the outer circumference with rotation and feeding the material to the main grinding surface 12A, and for its inclined angle, it is given that the inclined angle θ relative to the roller shaft is 67.5 degrees, and the inclined angle relative to the roller circumferential direction is 22.5 degrees.

That is, the outer circumferential surface 12 of the trapezoidal roller 10 includes a smooth main grinding surface 12A on the large-diameter side and a raw material transfer surface 12B on the small-diameter side, in which the screw grooves 11A are provided in the raw material discharging direction.

The main grinding surface 12A is defined as an area where the outer circumferential surface 12 of the roller is subjected to wear that is larger than two thirds of maximum wear, and a length of the main grinding surface 12A in the roller axial direction, that is, a horizontal width of the main grinding surface 12A in the trapezoidal roller is generally about 30 to 40% of the whole width of the roller.

Figure 2B:
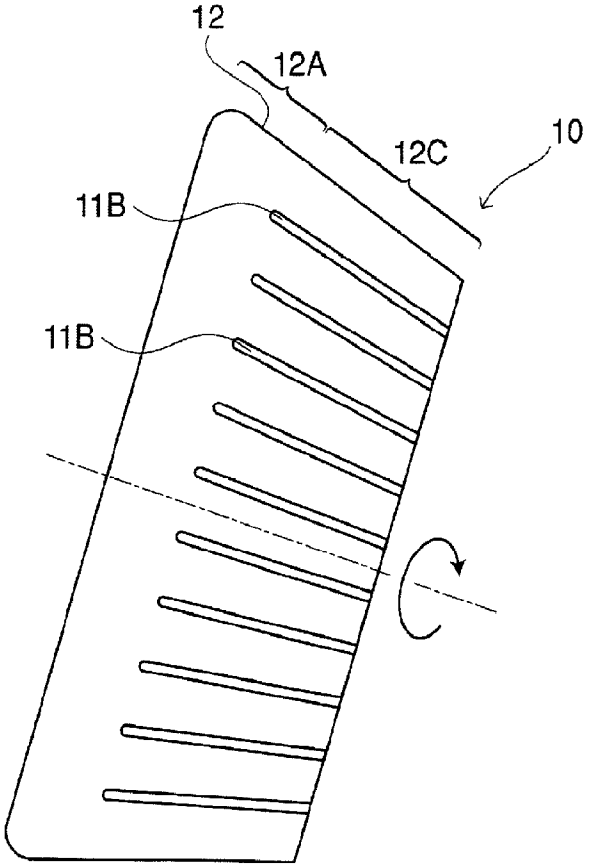
FIGS. 2A and 2B are front views showing a trapezoidal roller as another vertical mill roller of the present invention in comparison with a conventional roller.
Figure 2A:
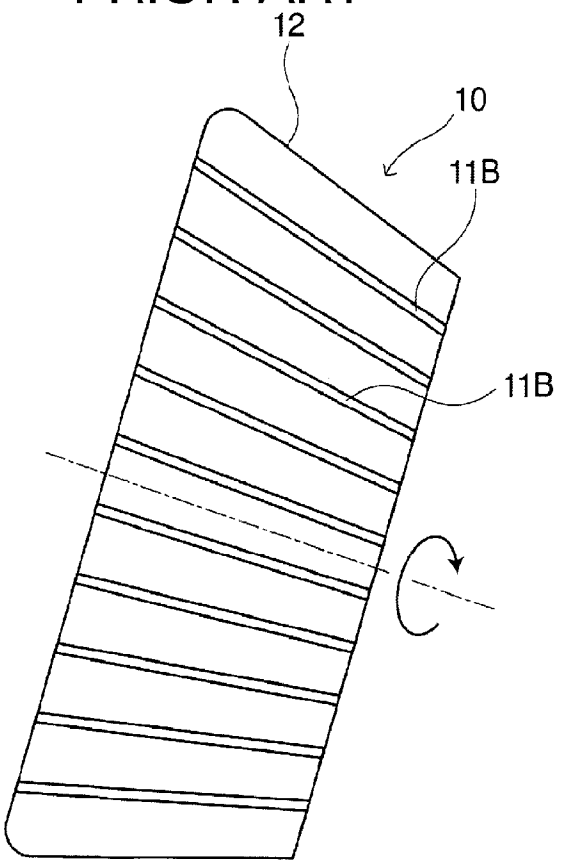
FIG. 2A PRIOR ART

The vertical mill roller shown in each of FIGS. 2A and 2B, like the vertical mill roller shown in each of FIGS. 1A and 1B, is the trapezoidal roller 10 used in the Loesche type vertical mill roller. The trapezoidal roller 10 shown in FIG. 2A is a conventional roller, and a plurality of slit grooves 11B vertical to the roller circumferential direction are formed in the entire outer circumferential surface at regular intervals in the roller circumferential direction. In the trapezoidal roller 10 shown in FIG. 2B, the outer circumferential surface 12 is broadly divided into the main grinding surface 12A on the large-diameter side and the other area, that is, a raw material biting surface 12C in which the plurality of slit grooves 11B vertical to the roller circumferential direction are formed at regular intervals in the roller circumferential direction.

Figure 3B:
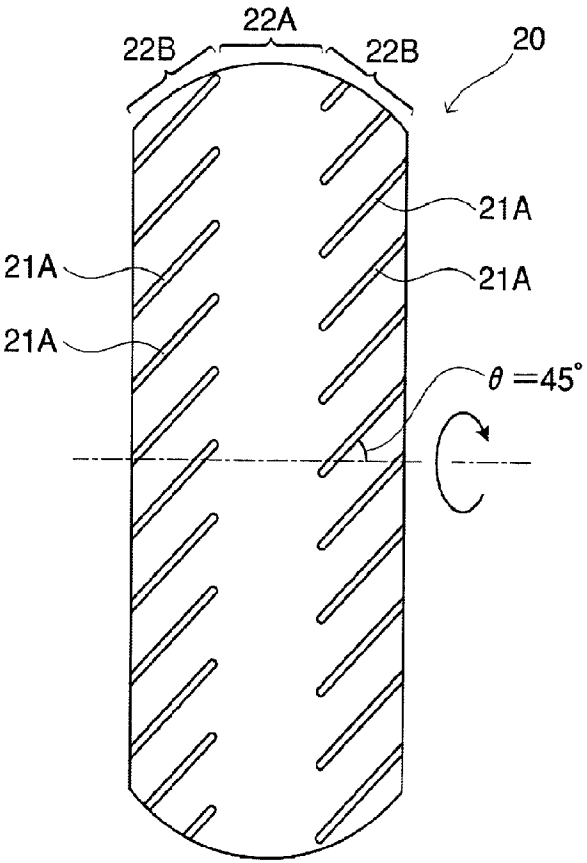
FIGS. 3A and 3B are front views showing a tire convex roller as another vertical mill roller of the present invention in comparison with a conventional roller.
Figure 3A:
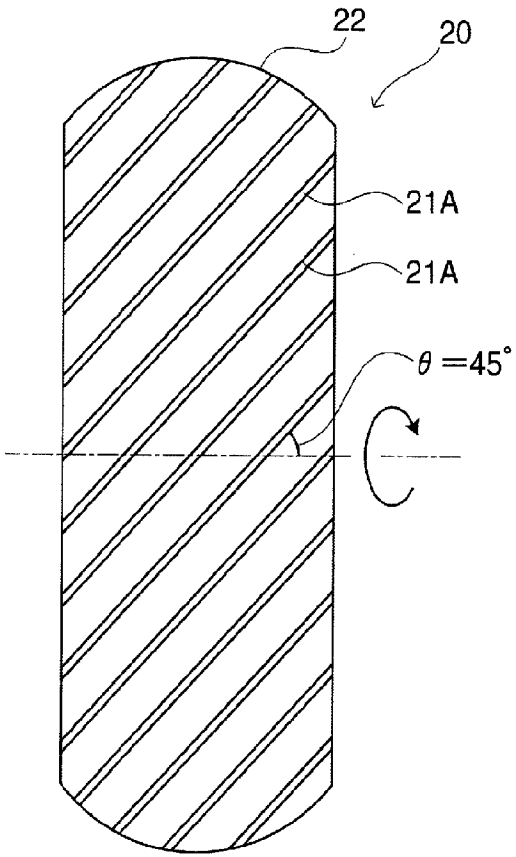
FIG. 3A PRIOR ART

The vertical mill roller shown in each of FIGS. 3A and 3B is a tire-type roller and a convex roller 20 having a small curvature (D/R=5). The tire convex roller 20 shown in FIG. 3A is a conventional roller, and a plurality of screw grooves 21A are formed in an entire outer circumferential surface 22 at regular intervals in the roller shaft direction. An inclined direction of the screw grooves 21A is a raw material discharging direction of actively transferring the ground raw material toward the outer circumference with rotation, and for its inclined angle, it is given that inclined angle θ relative to the roller shaft is 45 degrees, and the inclined angle relative to the roller circumferential direction is also 45 degrees.

The tire convex roller 20 shown in FIG. 3B is a roller according to the present invention in which the outer circumferential surface 22 includes the central smooth main grinding surface 22A on the large diameter-side and raw material transfer surface 22B, 22B on both sides (small-diameter side) in which the screw grooves 21A in the raw material discharging direction are formed at regular intervals in the roller shaft direction. For the inclined angle of the screw grooves 21A, it is given that inclined angle θ relative to the roller shaft is 45 degrees, and the inclined angle relative to the roller circumferential direction is also 45 degrees.

Figure 4B:
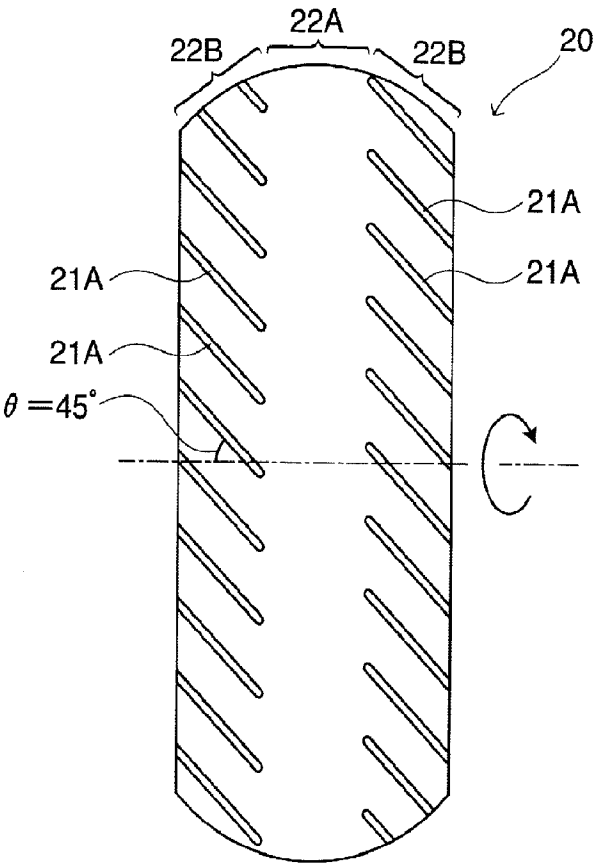
FIGS. 4A and 4B are front views showing another tire convex roller as still another vertical mill roller of the present invention in comparison with a conventional roller.
Figure 4A:
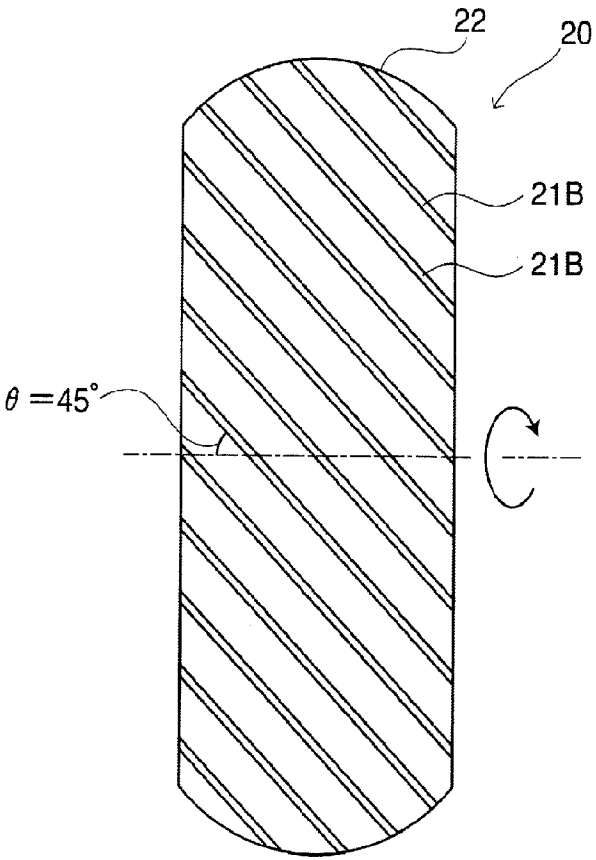
FIG. 4A PRIOR ART

The vertical mill roller shown in each of FIGS. 4A and 4B, like the vertical mill roller shown in each of FIGS. 3A and 3B, is a tire convex roller 20 (D/R=5). The trapezoidal roller 10 shown in FIG. 4A is a conventional roller, and as opposed to the vertical mill roller shown in each of FIGS. 4A and 4B, slit grooves 21B in the raw material collecting direction are formed in the entire outer circumferential surface 22 at regular intervals in the roller circumferential direction. On the other hand, the tire convex roller 20 shown in FIG. 4B is a roller according to the present invention in which the outer circumferential surface 22 includes the central smooth main grinding surface 22A and the raw material transfer surfaces 22B, 22B on the both sides (small-diameter side), in which the slit grooves 21B in the raw material collecting direction are formed at regular intervals in the roller circumferential direction. For inclined angle of the screw grooves 21A, the inclined angle θ relative to the roller shaft is 45 degrees, and the inclined angle relative to the roller circumferential direction is also 45 degrees.

Figure 5B:
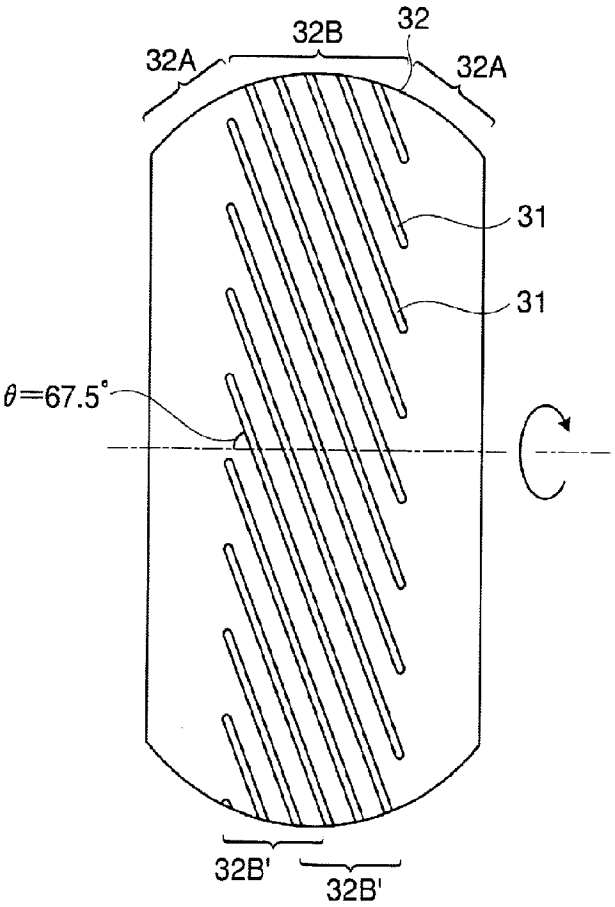
FIGS. 5A and 5B are front views showing a tire flat roller as still another vertical mill roller of the present invention in comparison with a conventional roller.
Figure 5A:
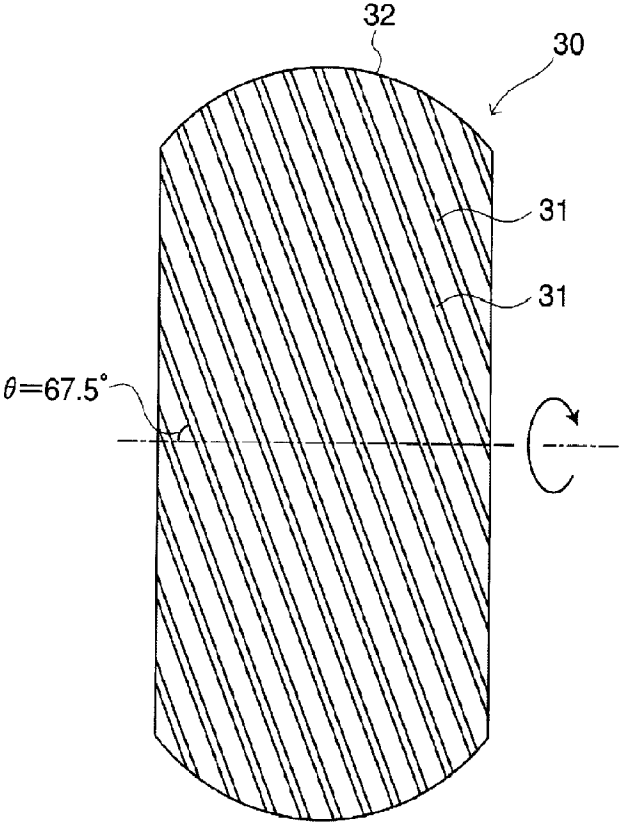
FIG. 5A PRIOR ART

The vertical mill roller shown in each of FIGS. 5A and 5B is a tire-type flat roller 30 having a large curvature (D/R=4). The tire flat roller 30 shown in FIG. 5A is a conventional roller in which a plurality of screw grooves 31A are formed on an entire outer circumferential surface 32 at regular intervals in the roller shaft direction. An inclined direction of the screw grooves 31A is a direction of collecting back the ground raw material toward the center with rotation, and for its inclined angle, it is given that the inclined angle θ relative to the roller shaft is 67.5°, and the inclined angle relative to the roller circumferential direction is 22.5 degrees.

On the other hand, the tire flat roller 30 shown in FIG. 5B is a roller according to the present invention in which the outer circumferential surface 32 includes smooth main grinding surfaces 32A, 32A on the small-diameter side, that is, the both sides, and a central raw material transfer surface 32B in which the screw grooves 31 in the raw material collecting direction are formed at regular intervals in the roller shaft direction. For the inclined angle of the screw grooves 31, it is given that the inclined angle θ relative to the roller shaft is 67.5 degrees, and the inclined angle relative to the roller circumferential direction is 22.5 degrees.

A feature of the tire-type rollers shown in FIGS. 3A to 5B is that they can be horizontally flipped and used twice. In particular, in the tire flat roller 30 shown in each of FIGS. 5A and 5B, since grinding is performed near the small-diameter side, generally, the roller is horizontally flipped and used twice. In individual use, grinding is performed in the one main grinding surface 32A and a part 32B' of the raw material transfer surface 32B. The horizontal width of the one main grinding surface 32A is generally 15 to 20% of the whole width of the roller, and the horizontal width of the total grinding surfaces 32A, 32A is about 30 to 40% of the whole width of the roller, which is the same as that of the trapezoidal roller.

On the contrary, in the tire convex rollers 20 shown in FIGS. 3A, 3B, 4A and 4B, since grinding is performed near the central large-diameter side, they cannot be often horizontally flipped. That is, in individual use, grinding is performed in the main grinding surface 22A and the one raw material transfer surface 22B, and in the horizontal flip, since the main grinding surface 22A overlaps and wear of the area extremely develops, horizontal flip becomes difficult. Like other rollers, the horizontal width of the main grinding surface 22A in this case is generally about 30 to 40% of the whole width of the roller.

EXAMPLE

Experimental Equipment

Figure 6:
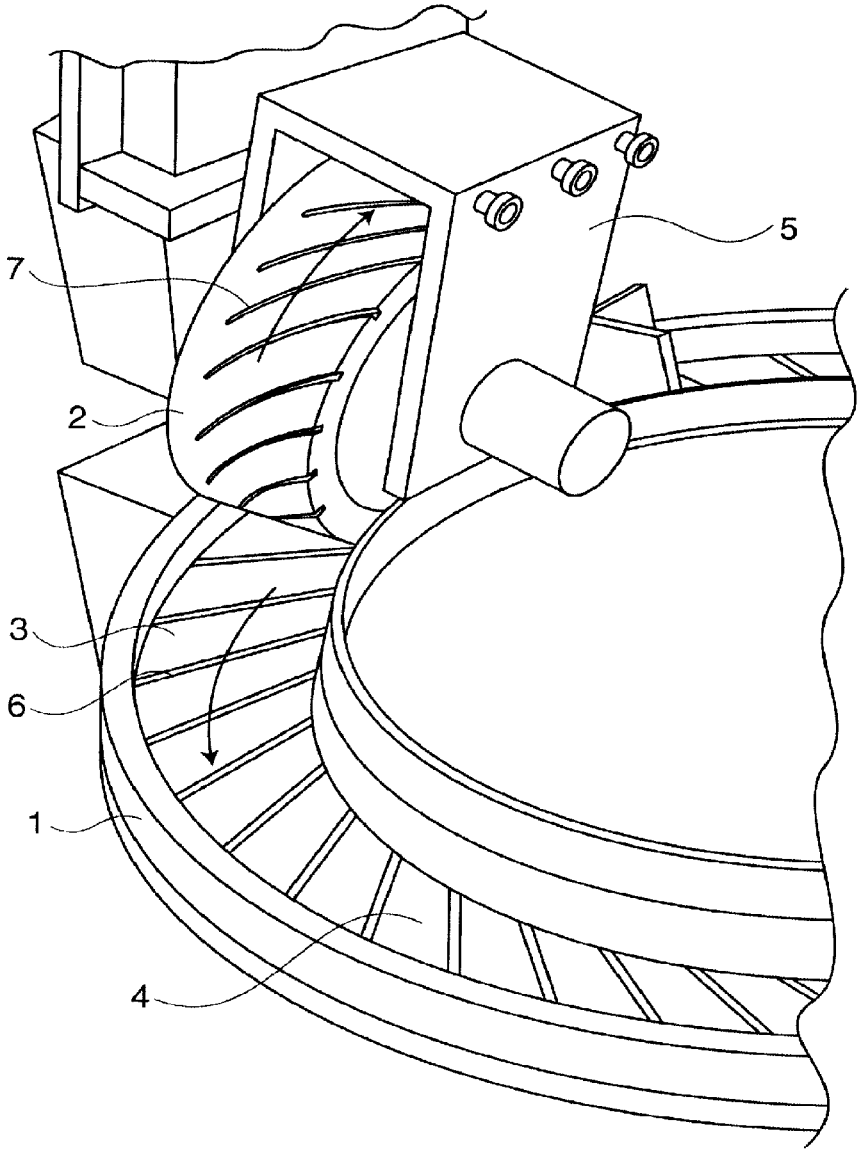
FIG. 6 is a configuration view showing an experimental compact grinder.

To estimate the effectiveness of the present invention, a Loesche type-like experimental compact grinder having the trapezoidal roller as a kind of the vertical roller mill was manufactured. As shown in FIG. 6, in this grinder, a grinding roller 2 is opposed to a surface of an outer circumference of a horizontal rotating table 1 as a base member. The grinding roller 2 is a vertical roller shaped like a truncated cone, and is arranged inclined such that the large-diameter side faces the outer circumferential side, the small-diameter side faces the center, and its surface opposed to a table 1 is horizontal. For purpose of a tester, the number of the rollers is one.

The outer circumferential surface of the grinding roller 2 has a plurality of screw grooves 7. The plurality of screw grooves 7 discharge the ground raw material from the rotational center toward the outer circumference with rotation, and feed the material into a grinding chamber formed of the rotating table 1 and the grinding roller 2.

In the rotating table 1, an outer circumferential part opposed to the grinding roller 2 is an annular grinding part 3, and for purpose of the tester, the annular grinding part 3 can be detached from a table body 4. As the grinding part 3, an interchangeable table, which had a smooth surface and slit grooves vertical to the table rotating direction or grooves vertical to the limestone feeding direction, the edges of which inclined at 60 degrees (Japanese Unexamined Patent Application Publication No. 2009-142809), was prepared. The grinding roller 2 was attached to a supporting mechanism 5 rotatably and vertically movably such that clearance between the grinding roller 2 and the grinding part 3 could be freely adjusted. To apply predetermined pressure to the ground raw material, the grinding roller 2 is biased toward the grinding part 3 by a spring.

With rotation of the rotating table 1, the rotating table 1 and the grinding roller 2 rotate relative to each other. In this test, to confirm the grinding property of the roller itself, a classifier by air of ground raw material was not provided. Accordingly, the ground raw material was discharged from the inside of the rotating table to the outside by the discharging capacity of the roller and the centrifugal force caused by rotation of the table. Thus, a collecting container 8 capable of completely collecting discharged limestone was provided outside of the rotating table.

The Loesche type compact tester was designed such that a tire-type table could be also attached by detaching the table 4. As a matter of course, the grinding roller attached to the supporting mechanism 5 was designed so as to be exchanged with the tire-type grinding roller. It was designed such that one tester could test all of the rollers and table. Further details of the tester will be described later.

Ground Raw Materials

Using the compact grinding tester, it was cleared whether or not the amount of ground fine powder increased when the grinding roller including the grinding surface of the grinding roller divided into the main grinding surface and the raw material transfer surface was actually used, as compared with the conventional case where the slit grooves or the screw groove were formed in the entire grinding surface. As ground raw materials used in the test, following two types:

1) limestone having a high adhesiveness 2) coal having a lower adhesiveness than limestone were selected.

Limestone Grinding Test

When grinding limestone, screw grooves were formed to prevent adhesion of limestone to the roller surface. The screw grooves of 67.5 degrees as an intermediate inclined angle relative to the roller shaft in a range of 45 to 85 degrees were selected. When the slit grooves inclined at an angle less than 45 degrees were used for grinding of limestone, the slit grooves were excellent in collecting the raw material, resulting in that limestone adheres to the roller surface, making the grinding operation difficult. Thus, the screw grooves of 45 degrees or larger were formed. The screw grooves of 45 degrees or larger were poor in collecting the raw material, and were excellent in the transfer property of transferring the raw material. As the angle is larger, the transfer property is improved, thereby decreasing adhesion of limestone to the roller surface. Specifically, a large gradient of 67.5 degrees was assumed as the most excellent inclined angle.

In this test, two types of rollers: the trapezoidal roller shown in each of FIGS. 1A and 1B and the tire flat roller shown in each of FIGS. 5A and 5B (D/R=4) were employed. For grooves, the case where the screw grooves were formed on the entire roller grinding surface [FIG. 1A, FIG. 5A] and the case where the main grinding surface was smooth and the screw grooves were formed in the other area [FIG. 1B, FIG. 5B] were selected. Differences in the amount of ground fine powder under 200 meshes and power consumption of this grinding tester between the rollers were measured and the electric power consumption rate was compared, thereby comparing the effectiveness of both of the grinding surfaces.

Figure 7:
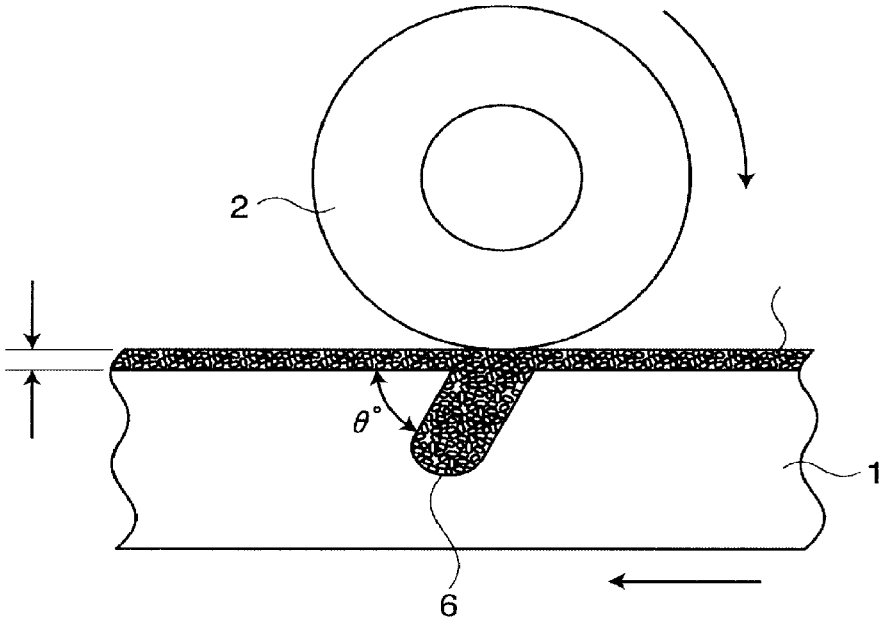
FIG. 7 is a vertical sectional view showing the shape of a groove in a table.

The shape of the slit grooves in the rotating table in this comparison test is shown in FIGS. 6 and 7. This groove shape is one of the shapes of the table grinding surface suitable for grinding of limestone, which are described in Japanese Unexamined Patent Application Publication No. 2009-142809. Size and grinding conditions of the trapezoidal roller and the tire flat roller are summarized as follows.

Roller Size:

Trapezoidal roller large diameter: 200 mm, small diameter: 170 mm, width: 57 mm

Tire flat roller (D/R=4) large diameter: 200 mm, tire R: 50 mm, width: 74 mm

Table Outer Diameter:

Trapezoidal roller outer diameter: 410 mm, inner diameter: 280 mm,

Tire flat roller outer diameter: 420 mm, inner diameter: 220 mm, groove R: 60 mm Circumferential speed: 30 RPM (left rotation)

Applied pressure: 23.5 kg

Clearance between roller and table: 0 mm

Test time: 30 minutes

Lime supplied amount: +/−1500 g/30 minutes

Lime supplying method: continuous supply screw feeder method

Temperature and humidity: 12 to 18° C., 60 to 89%

Limestone Used for the Test

Grain size: 1 to 3 mm

Grain size distribution (measured value after drying for 30 minutes)

10 meshes or more 46.0 g 16 meshes or more 44.0 g 30 meshes or more 9.0 g 60 meshes or more Tr P 0.5 g In the experimental grinder, the amount of limestone discharged to the outer circumference of the table, the amount of limestone remaining in the table, and the weight ratio of the grains passing through the 200 mesh screen and under 235 meshes to the total ground amount were examined. In this test, for convenience, only one grinding roller was used for grinding, two to four rollers were actually used, and the classifier for collecting fine powder was provided. Thus, numerical values of the amount of ground fine powder, which were obtained in the test, were different from those actually obtained. However, since the same tester is used, the findings are credible.

In grain size measurement, after the grinding test for 30 minutes, all of limestone discharged from the table to a collector 8 and limestone remaining in the table were correctly collected. The weight of the collected limestone was measured and then, three samples for grain size measurement were taken from any position of the collected limestone. For purpose of accuracy, an average value of the three samples was adopted as a result of grain size measurement.

The power consumption of the compact grinding tester was measured. A used power measuring device was "Cramp On Power High Tester 3168" manufactured by Hioki E.E. Corporation. The power consumption was an average value of numerical values measured in unit of second. In this test, an average value for 30 minutes was measured. This compact experimental grinder was 3-phase 220 V and has a power consumption of 750 W/H. A reason for measuring the power consumption is as follows. Although limestone was supplied to the mill with use of a screw feeder, the feeder often caused blockage, varying the supplied amount. When the supplied amount varied, the accuracy could not be ensured merely by comparison in the amount of ground fine powder under 200 meshes. Thus, the power consumption in each test grinding was measured, and the electric power consumption rate acquired by dividing the power consumption by the obtained ground amount of fine powder under 200 meshes was compared to ensure the accuracy.

The total amount of ground fine powder under 200 meshes for the grinding test time of 30 minutes, as well as the power consumption (Wh) necessary for the grinding were measured, and a numerical value acquired by dividing the measured power consumption by the total ground amount of fine powder under 200 meshes was defined as the electric power consumption rate. The electric power consumption rates of various combinations of the roller and the table grinding surface were obtained and compared.

Comparison Test Results

Results of the case of using the trapezoidal roller as the grinding roller are shown in Table 1.

TABLE 1

| Test number | Effective grinding surface area (%) | Layer thickness (mm) | Supplied amount (g) | Collected amount under 200 meshes (g) and content ratio (%) | Effective consumed power (Wh) | Electric power consumption rate of the amount under 200 meshes (Wh/g) |
|---|---|---|---|---|---|---|
| 1 | 85% | 8 | 1530 | 281 g<br>18.4% | 120 | 0.43 |
| 2 | 89% | 6 | 1260 | 295 g<br>23.4% | 117 | 0.40 |

A test number (1) is a combination of the roller shown in FIG. 1A in which the 67.5 degrees screw grooves are formed in the entire grinding surface in the discharging direction (effective grinding surface area 85%), and a table with right-angled slit grooves having edges inclined at 60 degrees. A test number (2) is the same as the test number (1) except that the roller shown in FIG. 1B in which the main grinding surface on the large-diameter side is made smooth, and the screw grooves are provided only in the other grinding surface on the small-diameter side (effective grinding surface area 89%) is used. Of the whole width of the test roller of 57 mm, the width of the smooth surface as the main grinding surface was set to 20 mm (about 35% of the whole width). The screw grooves were formed in the other grinding surface. The amount under 200 meshes and the electric power consumption rate in both cases were compared.

Table 1 shows comparison in the amount under 200 meshes and the electric power consumption rate (pressure applied to the roller is constant at 23.5 kg) between (1) the case where the screw grooves are formed in the entire grinding surface of the trapezoidal roller, and (2) the case where the main grinding surface is made smooth, and the screw grooves are formed in the other grinding surface.

Since the amount of supplied limestone in (1) was larger than the amount in (2), the effective power consumption slightly increased. However, the amount of ground fine powder under 200 meshes in (2) slightly increased from the amount in (1). Accordingly, comparing in the electric power consumption rate, (2) saved energy from (1) by about 7%. Although there was no substantial difference, when (2) the roller grinding surface was divided into the main grinding area and the transfer area, as compared to the case where the screw grooves were formed in the entire grinding surface, the amount of ground fine powder under 200 meshes improved, and the electric power consumption rate lowered.

Results in the case of the tire flat roller (D/R=4) as the grinding roller are shown in Table 2. Reasons for selecting the flat roller are as follows. The main grinding surface of this roller existed on the small-diameter side, and in the case of comparison at the same table rotating speed, the ground amount per unit time as well as the amount of ground fine powder in the flat roller were smaller than those of the convex roller. Accordingly, if a difference occurs in the state of a low ground amount of fine powder, the reliability of the present invention is considered to be high. As another reason, since the main grinding surface existed on the small-diameter side, it was easy to form the grinding surface.

TABLE 2

| Test number | Effective grinding surface area (%) | Layer thickness (mm) | Raw material supplied amount (30 minutes) (g) | Collected amount under 200 meshes (g) and content ratio (%) | Effective consumed power (Wh) | Electric power consumption rate of the amount under 200 meshes (Wh/g) |
|---|---|---|---|---|---|---|
| 1 | 81 | 5 | 1640 | 164 g 10.0% | 112 | 0.68 |
| 2 | 92 | 6 | 1590 | 186 g 11.7% | 107 | 0.58 |

A test number (1) is a combination of the roller shown in FIG. 5A in which the 67.5 degrees screw grooves are formed in the entire grinding surface in the collecting direction (effective grinding surface area 81%), and a table with right-angled slit grooves having edges inclined. A test number (2) is the same combination as the test number (1) except that the roller shown in FIG. 5B in which the smooth surfaces of the same width are formed on the both small-diameter sides and the 67.5 degrees screw grooves are formed inside it in the collecting direction (effective grinding surface area 92%) is used. In the test number (2), of the whole width of the roller of 74 mm, the width of the smooth surface as the main grinding surface was set to 25 mm (12.5 mm in width+12.5 mm in width, about 34% of the whole width).

Table 2 shows comparison in the amount under 200 meshes and electric power consumption rate between the case where 67.5 degrees screw grooves are formed in the entire grinding surface of the tire flat roller (D/R=4) and the case where the smooth surface as the main grinding surface of the rollers is arranged on either side of the small-diameter side, and the 67.5 degrees screw grooves are formed in the center. The screw grooves were formed in the direction of collecting the raw material to the inner side of the table.

The test number (2) in which the main grinding surface was made smooth, as compared to the test number (1) in which the screw grooves were formed in the entire grinding surface, increased the ground amount by about 12% and decreased the electric power consumption rate by about 15%. The tire flat roller was superior to the trapezoidal roller both in the amount of ground fine powder and the electric power consumption rate. Reasons for this are as follows.

In the trapezoidal roller, sine the raw material was ground between the roller surface and the table surface, the highly adhesive material such limestone was adhered to the roller surface and the table surface more easily, and the gap between the roller and the table, and in turn, the production volume of fine powder decreased. As a result, a difference in the shape of the grinding surface did not clearly cause a difference in the amount of ground fine powder. On the contrary, in the tire-type roller that performed linear grinding and passed the ground raw materials, material is less likely to be adhered to the roller, as compared with the trapezoidal roller, the difference in the grinding surface clearly appeared as the difference in the pulverizing amount. For grinding of adhesive limestone, in both of the trapezoidal roller and the tire flat roller, when the main grinding surface was made smooth, the amount of ground fine powder slightly increased, and the electric power consumption rate decreased by about 7% in the trapezoidal roller and by about 15% in the tire flat roller.

When limestone is ground by the vertical roller mill, it is highly difficult to increase the amount of ground fine powder under 200 meshes. Reasons for this are follows. Lime is easy to be adhered to the grinding roller, resulting in that the gap between the roller and the table, which is necessary for grinding, becomes small, and the biting amount at the gap lowers, thereby it is difficult to increase the amount of ground fine powder. Further, as limestone is finer, it is easier to be adhered again. As a result, the grains become large and are hard to be small. Even for such an adhesive substance, it is remarkable that when the main grinding surface is made smooth, the amount of ground fine powder increases. Thus, for the raw material having a low adhesiveness, it can be expected that the amount of collected fine powder dramatically increases.

Coal Grinding Test

Using the three types of rollers: the trapezoidal roller, the tire convex roller (D/R=5), and tire flat roller (D/R=4), as in limestone, a coal grinding test was made.

Grinding conditions are summarized as follows.

Used coal: steelmaking plant raw material coal

Grain size range -G-: 7 mm×7 mm≥G≥0.5 mm×0.5 mm

Initial Grain Size Distribution:

20 meshes or more 40 g 60 meshes or more 34 g 120 meshes or more 3 g 200 meshes or more 13 g 235 meshes or more 2 g P 9 g Water content 5%

Roller clearance: 0 mm

Roller surface pressure: 23.5 Kg

Table rotating speed: 60 RPM

Coal supplied amount: 2530 to 2850 g/30 minutes

Coal supply method: screw feeder continuous supply method

Test temperature and humidity: 18 to 34° C., 62 to 78%

The size of the trapezoidal roller and the tire flat roller is described in the paragraph of limestone and thus, description thereof is omitted. Details of only the tire convex grinding roller (D/R=5) will be described below.

Roller size (D/R=5)

Tire large diameter: 200 mm

Tire R: 40 mm

Tire width: 66 mm

Rotating Table Size

Outer diameter: 410 mm

Inner diameter: 230 mm

Groove R: 50 mm

Table 3 shows comparison in the amount under 200 meshes and electric power consumption rate (pressure applied to the roller is constant at 23.5 kg) between different grinding surfaces in the trapezoidal roller. The tables combined with the trapezoidal roller are all smooth surface tables.

TABLE 3

| Test number | Effective grinding surface area (%) | Layer thickness (mm) | Supplied amount (g) | Collected amount under 200 meshes (g) and content ratio (%) | Effective consumed power (Wh) | Electric power consumption rate of the amount under 200 meshes (Wh/g) |
|---|---|---|---|---|---|---|
| 1 | 100% | 2 | 2770 | 1108 g 40.0% | 158 | 0.14 |
| 2 | 85% | 3 | 2850 | 1378 48.4% | 152 | 0.11 |
| 3 | 89% | 3 | 2800 | 1514 g 54.1% | 156 | 0.10 |
| 4 | 86% | 2 | 2800 | 1396 g 49.9% | 147 | 0.11 |
| 5 | 91% | 2.5 | 2770 | 1506 g 54.4% | 150 | 0.10 |

Test number 1. Smooth surface roller

Test number 2. The 67.5 degrees screw grooves are formed in the entire grinding surface in the raw material discharging direction [FIG. 1A]

Test number 3. The main grinding surface is made smooth, and the 67.5 degrees screw grooves are formed on the other grinding surface of the raw material discharging direction [FIG. 1B]

Test number 4. The right-angled slit grooves are formed in the entire grinding surface [FIG. 2A]

Test number 5. The main grinding surface is made smooth, and the right-angled slit grooves are formed in the other surface [FIG. 2B]

Table 4 shows comparison in the amount under 200 meshes and electric power consumption rate (pressure applied to the roller is constant at 23.5 kg) between different grinding surfaces in the tire convex roller (D/R=5). The tables combined with the tire convex roller are all smooth surface tables. Of the whole width of the tire convex roller of 66 mm, the width of the smooth surface as the main grinding surface was set to 23 mm (35% of the whole width).

Test number 1. Smooth surface roller

Test number 2. The grooves inclined at 45 degrees in the discharging direction of the raw material are formed in the entire grinding surface [FIG. 3A]

Test number 3. The central main grinding surface is made smooth, and grooves inclined at 45 degrees in the discharging direction are formed in the other grinding surface [FIG. 3B] and Test number 4. The central main grinding surface is made smooth, and grooves inclined at 45 degrees in the collecting direction are formed in the other grinding surface [FIG. 4B]

Table 5 shows comparison in the amount under 200 meshes and electric power consumption rate (pressure applied to the roller is constant at 23.5 kg) between different grinding surfaces in the tire flat roller (D/R=4). The tables combined with the tire flat roller are all smooth surface tables.

TABLE 4

| Test number | Effective grinding surface area (%) | Layer thickness (mm) | Supplied amount (g) | Collected amount under 200 meshes (g) and content ratio (%) | Effective consumed power (Wh) | Electric power consumption rate of the amount under 200 meshes (Wh/g) |
|---|---|---|---|---|---|---|
| 1 | 100% | 1 | 2780 | 1012 g 36.4% | 161 | 0.16 |
| 2 | 83% | 1 | 2790 | 1136 g 40.7% | 146 | 0.13 |
| 3 | 93% | 1 | 2760 | 1348 g 48.9% | 172 | 0.13 |
| 4 | 93% | 1 | 2770 | 1236 g 44.6% | 162 | 0.13 |

TABLE 5

| Test number | Effective grinding surface area (%) | Layer thickness (mm) | Supplied amount (g) | Collected amount under 200 meshes (g) and content ratio (%) | Effective consumed power (Wh) | Electric power consumption rate of the amount under 200 meshes (Wh/g) |
|---|---|---|---|---|---|---|
| 1 | 100% | 1 | 2840 | 716 g 25.2% | 151 | 0.21 |
| 2 | 81% | 1 | 2820 | 618 g 21.9% | 145 | 0.28 |
| 3 | 92% | 1.5 | 2850 | 826 g 29.0% | 146 | 0.18 |

Test number 1. Smooth surface roller

Test number 2. The 67.5 degrees screw grooves in the direction of collecting back the raw material are formed in the entire grinding surface [FIG. 5A]

Test number 3. The main grinding surfaces on both the small-diameter sides are made smooth, and the 67.5 degrees screw grooves are formed in the other central grinding surface in the raw material collecting direction [FIG. 5B]

In coal grinding, by making the main grinding surface smooth in all of the three types of rollers: the trapezoidal roller, the tire convex roller and the tire flat roller, the amount of ground fine powder under 200 meshes greatly increased. By making the main grinding surface smooth, the electric power consumption rate representing the amount of energy necessary for grinding also exhibited a minimum value. By making the main grinding surface smooth surface, even when either of the right-angled slit grooves and 45 degrees slit grooves for collecting the raw material and the 67.5 degrees screw groove having the excellent transfer property of the raw material were formed in the other grinding surface, a pronounced effect was obtained. Importantly, even in the case where the right-angled slit grooves were formed in the trapezoidal roller, the amount of ground fine powder was the almost same as the case where the 67.5 degrees screw grooves were formed.

In the trapezoidal roller, a difference between the effect of the 67.5 degrees screw groove having the excellent transfer property and the effect of the right-angled slit grooves having the excellent biting property was examined. The amount of ground fine powder of the roller in which the 67.5 degrees screw grooves were formed in the raw material discharging direction increased from that of the normal trapezoidal roller having the smooth surface by about 20%. The increase of the amount of ground fine powder was due to the biting property as a secondary function and the raw material transfer property as a primary function of the 67.5 degrees screw grooves. By making the main grinding surface of the roller smooth, the amount of ground fine powder increased by about 9%. That is, the main smooth surface contributed to an increase of about 9%.

In the trapezoidal roller, the amount of ground fine powder of the roller in which the right-angled slit grooves in parallel to the roller shaft are formed in the entire grinding surface increased from that of the normal smooth surface roller by about 21%. The increase of the amount of ground fine powder was due to the biting property of the right-angled slit grooves. By making the main grinding surface of the roller smooth, the amount of ground fine powder increased by about 7%. That is, the main smooth surface contributed to an increase of about 7%. It is assumed that the reason for a decrease from the former case by 2% is that the right-angled slits are inferior to the screw grooves in the transfer property.

As a conclusion, it turned out that, in the trapezoidal roller, even when either of the right-angled slit grooves having the excellent biting property and the 67.5 degrees screw grooves having the excellent raw material transfer property were adopted, the almost same ground amount of fine powder could be obtained. Therefore, the right-angled slit grooves having the grinding edges directly engaged with the ground raw material straightforward should be applied to grinding of the soft raw material in terms of wear. Since the 67.5 degrees screw grooves were excellent in the function of smoothly feeding the raw material to the main grinding surface, the grooves should be applied to the hard raw material or moist raw material.

For grinding of adhesive limestone and coal, it was proved that the grinding surface of the vertical grinding roller should be divided into the main grinding surface and the transfer surface transferring the raw material, which had different functions. Further, it was also proved that, by making the main grinding surface smooth, wear could be reduced and the amount of ground fine powder could be increased.

Although the slit grooves and the screw grooves that have the biting property and the transfer property are mainly employed in this example, as a matter of course, protruding ribs in place of these grooves can achieve the same effect. However, in the case of the convex ribs, the height of the ribs is limited to the range of 5 to 20 mm. The reason is that the ribs directly face the ground raw material and thus, is greatly worn. Accordingly, the ribs are made of a material having a high wear resistance, but when the wear resistance is too high, the ribs tend to be broken by shock of the raw material.

Although the slit grooves, the screw grooves, and the convex ribs are basically continuous in the longitudinal direction, they may be intermittently formed in the longitudinal direction, and such intermittent arrangement is especially suitable for the convex ribs.

By setting up a hypothesis by theoretical deduction and supporting the hypothesis in the grinding tests, the perfect shape of the grinding surface of the vertical mill roller researched by the present inventors for a long time was established.

EXPLANATION OF REFERENCE NUMERALS

10 vertical mill roller (trapezoidal roller)
11A screw groove
11B slit grooves
12 outer circumferential surface
12A main grinding surface
12B raw material transfer surface
12C raw material biting surface
20 vertical mill roller (tire convex roller)
21A, 21B screw groove
22 outer circumferential surface
22A main grinding surface
22B raw material transfer surface
30 vertical mill roller (tire flat roller)
31 screw groove
32 outer circumferential surface
32A main grinding surface
32B raw material transfer surface

The invention claimed is:

1. A vertical mill roller comprising:

an outer circumferential surface that surrounds a rotational axis of the roller, the outer circumferential surface connecting a first edge of the roller and a second edge of the roller, the first and second edges being spaced apart in the axial direction, a first grinding surface that continuously occupies a first width portion of the outer circumferential surface in the axial direction; and a second grinding surface that continuously occupies a second width portion of the outer circumferential surface in the axial direction, the second width portion being separate from the first width portion, wherein the outer circumferential surface curves outward from the first edge and curves outward from the second edge such that a maximum diameter (D) of the roller is formed at a maximum-diameter portion of the outer circumferential surface that protrudes outward between the first edge and the second edge, wherein the first grinding surface is smooth, and wherein the second grinding surface includes at least one of a slit groove and a screw groove, the slit groove being defined as at least one of a groove that intersects the circumferential direction of the roller at an angle of 90 degrees and a groove inclined at an angle exceeding 45 degrees relative to the circumferential direction of the roller, and the screw groove being defined as a groove inclined at an angle of 45 degrees or smaller relative to the circumferential direction of the roller.

2. The vertical mill roller according to claim 1, wherein the first grinding surface includes the maximum-diameter portion of the roller, the maximum-diameter portion being formed centrally in the axial direction between the first edge and the second edge.

3. The vertical mill roller according to claim 2, wherein the outer circumferential surface has a radius of curvature (R) in a plane normal to the rotating direction of the roller and a ratio (D/R) of the maximum diameter (D) to the radius of curvature (R) is 4.3 or higher.

4. The vertical mill roller according to claim 1, wherein the first grinding surface includes a first small-diameter portion of the outer circumferential surface in the axial direction between the first edge and the maximum-diameter section and a second small-diameter portion of the outer circumferential surface in the axial direction between the maximum-diameter section and the second edge.

5. The vertical mill roller according to claim 4, wherein the outer circumferential surface has a radius of curvature (R) in a plane normal to the rotating direction of the roller and a ratio (D/R) of the maximum diameter (D) to the radius of curvature (R) is less than 4.3.

6. The vertical mill roller according to claim 1, wherein an inclined angle of the screw groove is 5 degrees or higher relative to the roller circumferential direction.

7. The vertical mill roller according to claim 1, wherein the first grinding surface includes an area that is subjected to wear that is two thirds of maximum wear or larger, and wherein a total width of the first grinding surface falls within a range of 30% to 40% of an entire width of the roller in the axial direction.

* * * * *